US006192542B1

(12) United States Patent
Frederick et al.

(10) Patent No.: US 6,192,542 B1
(45) Date of Patent: Feb. 27, 2001

(54) SWEEPER CONVEYOR OVERFLOW AND LEAKAGE RECYCLING RAMP

(75) Inventors: Sherman B. Frederick, Minneapolis; Mark D. Kinter, Spring Park; Richard Mark Pierce, Coon Rapids, all of MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 09/396,648

(22) Filed: Sep. 15, 1999

(51) Int. Cl.[7] ..... E01H 1/05
(52) U.S. Cl. ..... 15/84; 15/340.3
(58) Field of Search ..... 15/83, 84, 85, 15/86, 340.1, 340.3, 340.4

(56) References Cited

U.S. PATENT DOCUMENTS 3,649,982 * 3/1972 Mortensen ..... 15/84
4,516,285 * 5/1985 Pineau ..... 15/84
4,549,326 * 10/1985 Pineau ..... 15/84
4,754,521 * 7/1988 Zoni ..... 15/84
4,884,313 * 12/1989 Zoni ..... 15/340.3
4,914,773 * 4/1990 Ham ..... 15/84
5,251,652 * 10/1993 Strauser et al. ..... 15/84
5,630,286 * 5/1997 Vanderlinden ..... 15/340.3

* cited by examiner

*Primary Examiner*—Terrence R. Till
(74) *Attorney, Agent, or Firm*—Cook, Alex, McFarron, Manzo, Cummings & Mehler

(57) ABSTRACT

A wheel supported sweeping machine includes a hopper which is movable between operating and non-operating positions and a conveyor which is adjacent the hopper and is similarly movable between a lower operating position and a raised non-operating position. There is a cylindrical brush mounted on the frame which directs debris into the conveyor, with the conveyor raising the debris for deposit into an opening in the upper end of the hopper, which is aligned with a similar opening in the conveyor. At times, debris may fall into the space between the conveyor enclosure and hopper. A debris collecting ramp is located beneath the hopper and extends upwardly and rearwardly toward the hopper from the conveyor enclosure. There is a seal between the ramp and conveyor enclosure which prevents debris from falling downwardly until the conveyor enclosure has been raised, at which time, the debris will be deposited by the ramp through a lower opening in the conveyor enclosure to an area in the front of the brush.

5 Claims, 3 Drawing Sheets

Fig. 2
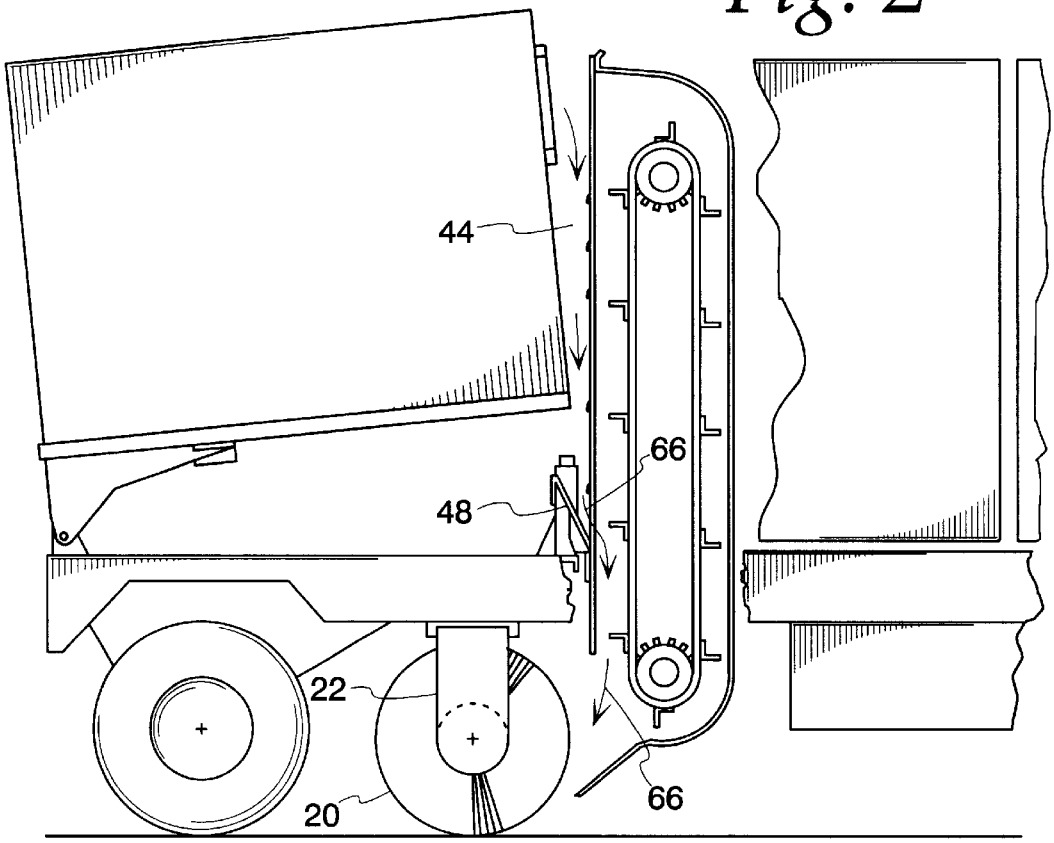
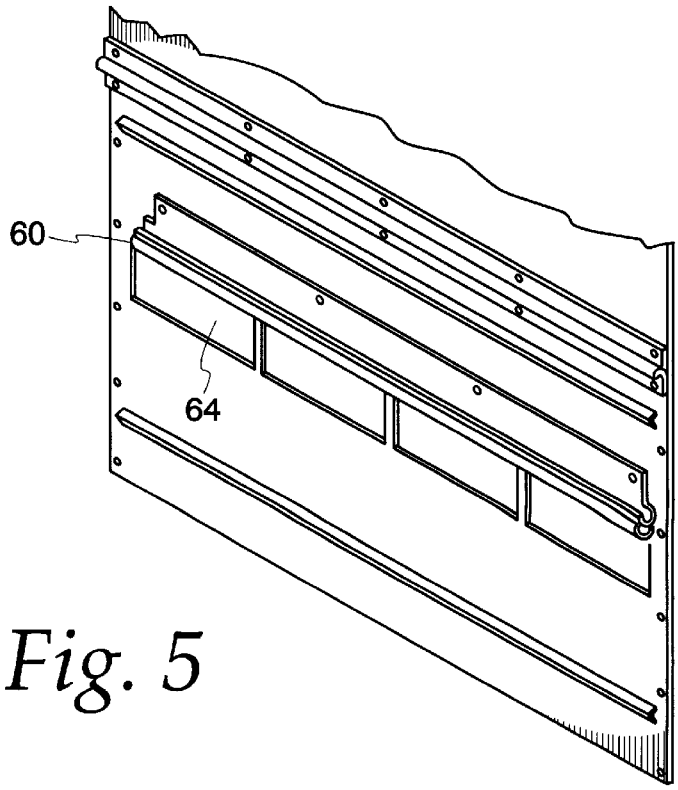
Fig. 5

SWEEPER CONVEYOR OVERFLOW AND LEAKAGE RECYCLING RAMP

FIELD OF THE INVENTION

The present invention relates to sweepers for use primarily in large outdoor areas such as streets, parking lots and the like, but also indoors in large industrial facilities. Such sweepers utilize a large debris hopper, a cylindrical sweeping brush, and a conveyor which moves debris swept by the cylindrical brush up to an opening near the top of the hopper. The sweeping compartment maybe enclosed and vacuumized to limit dust generated by sweeping. Although there is a seal between the conveyor enclosure and the hopper, at times, particularly when the hopper and conveyor are raised into a non-sweeping position, the debris may fall down and collect on the frame and in the moving parts of the mechanism which tilts and lifts the hopper for dumping, causing potential malfunctions and requiring constant maintenance. The present invention is directed to a simply constructed and reliable recycling ramp, which will substantially eliminate cleaning of the machinery on the vehicle adjacent the hopper and conveyor. The ramp collects debris which may fall down into the space between the hopper and conveyor enclosure, and holds this debris until such time as the conveyor and hopper are raised to a non-operating position, when the ramp becomes aligned with a lower opening in the conveyor enclosure and the debris slides down either into the conveyor enclosure or into the space beneath the conveyor and in front of the sweeping brush.

SUMMARY OF THE INVENTION

The present invention relates to sweepers for use in areas such as streets, parking lots, large industrial facilities, and in particular to a system for collecting overflow and leakage debris which may fall between the hopper and conveyor and foul portions of the machinery that moves the conveyor and hopper.

Another purpose of the invention is to provide a simply constructed reliable ramp and related seal, which prevents overflow and leakage debris from clogging the sweeper mechanisms.

Another purpose is a conveyor enclosure for the described use which has a normally sealed opening adjacent the collecting ramp to keep the vacuumizing air flow directed to the sweeping area, which opening is aligned with the ramp when the conveyor enclosure is raised to a non-operating position.

Another purpose is a conveyor enclosure for the described use which has a normally sealed opening adjacent the collecting ramp to keep the vacuumizing airflow directed to the sweeping area, which opening is aligned with the ramp when the conveyor enclosure is raised to a non-operating position.

Other purposes will appear in the ensuing specification, drawings and claims.

DESCRIPTION OF THE DRAWINGS

The invention is illustrated diagrammatically in the following drawings wherein:

FIG. 2. is a partial side view, similar to FIG. 1, but showing the conveyor and hopper in a raised position;

FIG. 5 is a perspective view illustrating the opening in the conveyor enclosure;

DESCRIPTION OF THE PREFERRED EMBODIMENT

Figure 1:
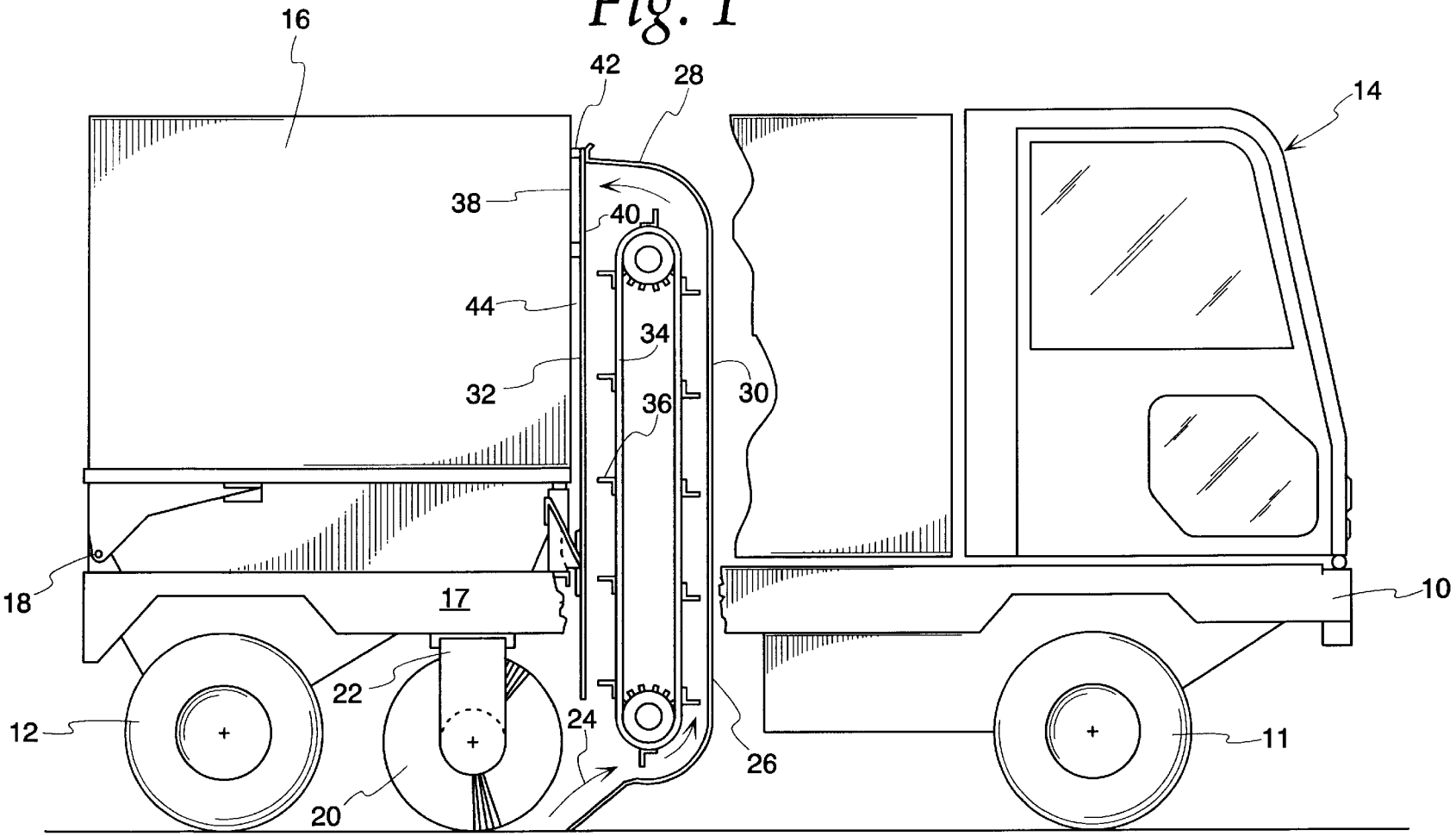
FIG. 1 is a side view, with portions broken away, showing the sweeper, hopper and conveyor in a lowered operating position.

FIG. 1 illustrates a sweeper of a type sold by Tennant Company of Minneapolis, Minn. under the model designations 830 and 830II and which is principally used to clean streets, parking lots and similar outdoor areas, but is also used to clean large indoor industrial areas. The vehicle includes a frame 10 supported by front wheels 11 and rear wheels 12 and there is a driver's cab indicated generally at 14 where the vehicle operator has all of the customary controls for operating the sweeper.

There is a hopper indicated generally at 16 and which is pivoted, as at 18, to be moved between the lower operating position of FIG. 1 and the raised non-operating position of FIG. 2. A generally cylindrical sweeping brush 20 is mounted on spaced supports 22 and extends generally transverse of the frame and substantially the entire width of the machine as does the hopper 16 and conveyor, discussed hereafter.

Debris swept by the brush 20, as controlled by the operator within the cab 14, is directed, as shown by the arrow 24, into a conveyor 26. The conveyor 26 has an enclosure 28 with a front wall 30 and a rear wall 32. Within the enclosure 28, there is a flexible drive member 34 and a series of spaced paddles 36. When the conveyor is operated, the debris swept by the brush 20 in the direction of arrow 24, will be picked up by the paddles 36 and raised to the upper end of the conveyor enclosure where it will be deposited in the hopper 16 through aligned openings 40 in the upper end of the conveyor enclosure rear wall 32 and 38 in the front wall of the hopper 16. A seal 42 is effective to peripherally close the space between the aligned openings 38 and 40.

As shown in FIG. 1 and FIG. 2, there is a space 44 between the rear wall 32 of the conveyor enclosure 28 and the front wall of the hopper 16. There is the potential for debris to fall into this space, either from the hopper being overloaded and leaking through the seal, or when either the conveyor or hopper is moved relative to the other. The present invention is particularly directed to ensuring that this debris does not fall down into the machinery which controls movement of the hopper and the conveyor enclosure and the adjacent areas of the vehicle frame. This machinery is located in the general area 17 in FIG. 1, under the hopper 16.

Figure 6:
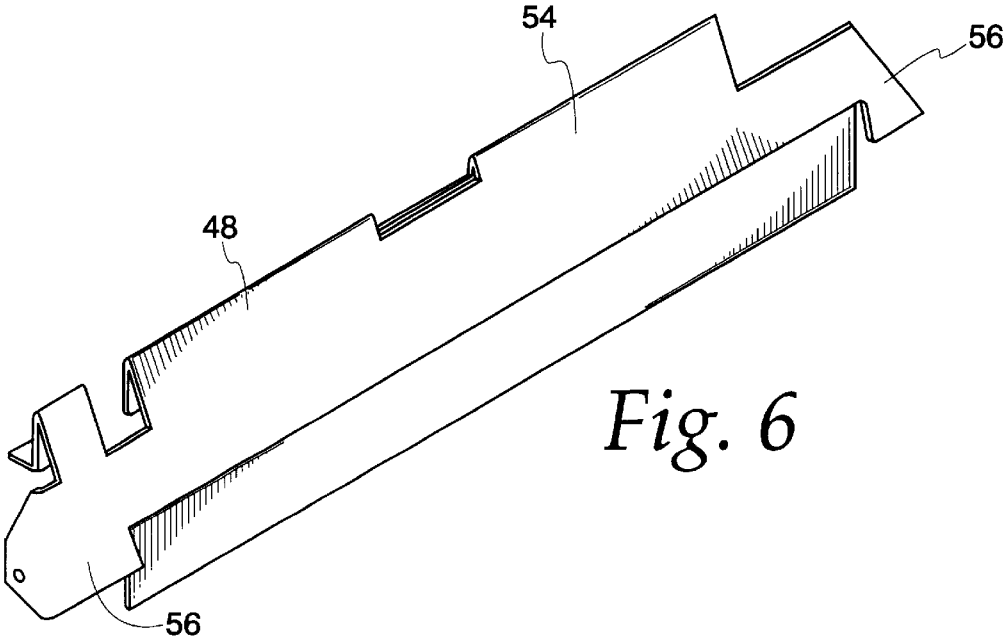
FIG. 6 is a perspective view of the ramp.

The frame 10 includes a cross beam 46, which mounts a ramp indicated generally at 48, and shown in detail in FIG. 6. The ramp 48 is attached to a lower mounting plate 50, which may be welded or otherwise secured to the upper surface of the beam 46, with the plate 50 being attached by bolts 52 to the main body 54 of the ramp. The ramp extends, as shown particularly in FIGS. 3 and 4, across the space 44 between the rear wall of the conveyor enclosure and the front wall of the hopper. The ramp is located beneath the hopper. The lower front of the ramp, indicated at 56, extends downwardly, masking a lower opening 58 in the conveyor enclosure 28. There is a transversely extending seal 60, attached by bolts 62, to the rear wall of the conveyor enclosure 32. The seal 60, in combination with the ramp, effectively closes the bottom of the space 44, when the conveyor is in the position of FIG. 1, preventing debris from reaching the sweeper moving parts which control raising and lowering of the hopper and conveyor.

FIG. 5 illustrates the rear wall of the conveyor enclosure. The opening 58 is formed by a plurality of generally uniform windows 64, which are located directly beneath the seal 60 and its support on the conveyor enclosure.

Figure 3:
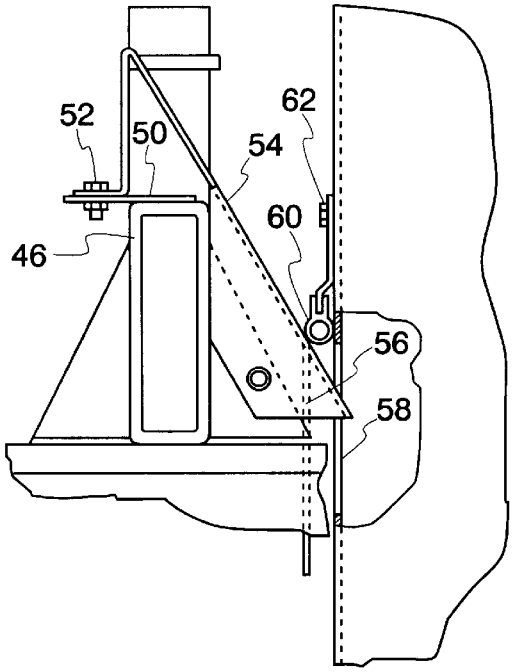
FIG. 3 is an enlarged side view, illustrating the ramp for collecting debris and the opening in the conveyor enclosure when the hopper and the conveyor are in the FIG. 1 position.
Figure 4:
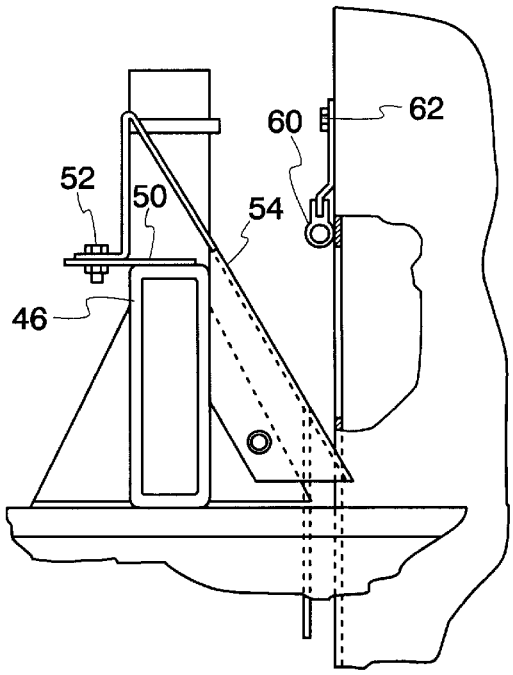
FIG. 4 is an enlarged side view, similar to FIG. 3, but illustrating the conveyor and hopper in a raised position.

When the conveyor and hopper are in the operating position of FIGS. 1 and 3, debris which may have collected within the space 44 is held by the ramp. However, when the conveyor and the hopper are raised to the non-operating position of FIGS. 2 and 4, the opening 58 is now aligned with the lower end of the ramp, the seal 60 has been raised and debris collected in this area will flow down, as shown by the arrows 66 in FIG. 2, to the area within the conveyor enclosure from where such debris may fall down to the space directly in front of the sweeping brush 20. When the brush is activated, the debris will again be swept into the conveyor for subsequent deposit in the hopper. Thus, the ramp, the opening in the conveyor enclosure and the seal, during normal sweeping operation, prevent debris from reaching the mechanisms on the sweeper which need to be protected and which in the past have required regular cleaning to maintain them in operating condition.

The invention provides a simple structure for alleviating a serious problem which required frequent cleaning of the sweeper to maintain the conveyor and hopper movement mechanisms in operating condition. This is accomplished by the ramp, which normally closes off the space between the hopper and conveyor, but when the conveyor is moved to a non-operating position an opening in the conveyor enclosure is raised into alignment with the ramp so that the collected debris may be deposited in front of the sweeping brush.

Whereas the preferred form of the invention has been shown and described herein, it should be realized that there may be many modifications, substitutions and alterations thereto.

What is claimed is:

1. A sweeping machine including a frame, wheels supporting the frame for movement over a surface to be swept, a hopper on the frame and pivotally mounted for movement between a lower operating position and a raised non-operating position, a cylindrical rotating cleaning brush mounted generally transversely of the frame, a conveyor mounted on the frame in a generally upright position and movable between a lower operating position and a raised non-operating position, said conveyor being located to collect debris swept by the brush and to raise such debris for deposit in the hopper through an opening in the hopper generally in alignment with an upper portion of the conveyor, an enclosure for said conveyor and having an upper opening generally in alignment with the hopper opening, a seal extending at least partially about the aligned hopper and conveyor openings to prevent debris moved by the conveyor to the hopper from falling into a space between the hopper and conveyor enclosure, and a ramp, fixed on the frame and extending from adjacent the conveyor enclosure upwardly and rearwardly toward and beneath the hopper and generally adjacent the bottom of the space between the hopper and conveyor enclosure, a seal between said ramp and conveyor enclosure, a lower opening in the conveyor enclosure, said lower opening being located beneath the ramp seal, said seal preventing debris on the ramp from reaching the lower conveyor opening when the conveyor and hopper are in the lower operating position, said ramp being aligned with the lower conveyor opening when the conveyor and hopper are in a raised non-operating position whereby any debris in the space between the hopper and conveyor enclosure will fall from the ramp into the conveyor enclosure.

2. The sweeping machine of claim 1 wherein the brush, conveyor and hopper extend generally transversely across the machine through substantially the full width thereof.

3. The sweeping machine of claim 1 wherein the conveyor includes a flexible drive member and a series of generally spaced paddles to raise debris from the area adjacent the brush, up to the aligned openings in the conveyor enclosure and hopper.

4. The sweeping machine of claim 1 wherein the ramp is fixed to the frame beneath the hopper and has a lower front wall which masks the lower conveyor enclosure opening when the hopper and conveyor are in the lower operating position.

5. The sweeping machine of claim 4 wherein the seal between the ramp and conveyor enclosure is fixed to the conveyor enclosure and is directly adjacent and above the lower conveyor enclosure opening.

* * * * *